United States Patent [19]

Takahashi et al.

[11] Patent Number: 4,565,907

[45] Date of Patent: Jan. 21, 1986

[54] IGNITION DISTRIBUTOR FOR INTERNAL COMBUSTION ENGINE

[75] Inventors: Ken Takahashi, Ibaraki; Ryutarou Jimbou, Hitachiota; Yasuo Matsushita, Hitachi; Seiichi Yamada; Tetuo Kosugi, both of Ibaraki, all of Japan

[73] Assignee: Hitachi, Ltd., Tokyo, Japan

[21] Appl. No.: 634,470

[22] Filed: Jul. 25, 1984

[30] Foreign Application Priority Data

Jul. 27, 1983 [JP] Japan ..... 58-138102

[51] Int. Cl.[4] ..... H01H 19/00

[52] U.S. Cl. ..... 200/19 DR; 123/633

[58] Field of Search ..... 200/19 R, 19 DR, 264, 200/262, 265, 266, 267; 123/146.5 A, 633

[56] References Cited

U.S. PATENT DOCUMENTS 4,007,342 2/1977 Makino et al. ..... 200/19 DR X 4,074,090 2/1978 Hayashi et al. ..... 200/19 DR 4,217,470 8/1980 Kirner ..... 200/19 R 4,369,343 1/1983 Sone et al. ..... 260/19 R

FOREIGN PATENT DOCUMENTS 52-119730 10/1977 Japan .

*Primary Examiner*—J. R. Scott

*Attorney, Agent, or Firm*—Antonelli, Terry & Wands

[57] ABSTRACT

An ignition distributor for an internal combustion engine with reduced electric discharge energy and suppressed radio noise generation comprises a rotor electrode capable of rotary motion and a plurality of stationary electrodes arranged substantially in a circle around the rotor electrode through an electric discharge clearance therebetween, where the rotor electrode is a sintered mixture comprising an aluminum compound and/or a boron compound and silicon carbide and having a specific resistance of 10 to $10^6$ Ωcm at room temperature.

5 Claims, 3 Drawing Figures

IGNITION DISTRIBUTOR FOR INTERNAL COMBUSTION ENGINE

BACKGROUND OF THE INVENTION

1. Field of the Invention

This invention relates to an ignition distributor for internal combustion engine, and more particularly to an ignition distributor for internal combustion engine with reduced generation of radio noise.

2. Description of the Prior Art

Generally, internal combustion engines having an electric ignition system generate radio noise in a wide frequency range, which disturb radio broadcasting service, television broadcasting service and other kinds of radio communication systems. Particularly, the radio noise from the internal combustion engines of vehicles gives a disturbance to electronic appliances now provided on the vehicles for versatile applications and gives an adverse effect on the vehicle running. One of the noise generation sources is an electric discharge at the ignition distributor for the internal combustion engine.

Attempts have been so far made to suppress the noise generation at the ignition distributor, one of which is to provide a resistor of a few KΩ at the intermediate part of a rotor electrode in the ignition distributor to suppress generation of radio noise with high frequency. However, a discharge voltage is high between the rotor electrode and the stationary electrode and an energy loss during the electric discharge is high in such an attempt, resulting in a less effect on suppression of radio noise generation.

Another attempt is to provide a resistor or a dielectric as projected at the tip end of the metallic rotor electrode, where a precursor electric discharge takes place between the resistor or the dielectric and the stationary electrode, and the main electric discharge then takes place therebetween. That is, the electric discharge energy can be reduced, but no effect on oscillation suppression of the main electric discharge current can be obtained, and a less effect on reduction in the radio noise generation can be attained.

SUMMARY OF THE INVENTION

An object of the present invention is to provide an ignition distributor for an internal combustion engine with less electric discharge energy and reduced radio noise generation.

According to the present invention, an ignition distributor for an internal combustion engine is characterized by using a sintered mixture comprising an aluminum compound and/or a boron compound and silicon carbide and having a specific resistance of 10 to $10^6$ Ω·cm at room temperature as a rotor electrode.

That is, according to the present invention, an ignition distributor for an internal combustion engine is provided, which comprises a rotor electrode capable of rotary motion and a plurality of stationary electrodes arranged substantially in a circle around the rotor electrode through an electric discharge clearance therebetween, the rotor electrode being a sintered mixture comprising an alluminum compound and/or a boron compound, and silicon carbide and having a specific resistance of 10 to $10^6$ Ω·cm at room temperature.

The rotor electrode of the present ignition distributor comprises a sintered mixture of at least one of aluminum compounds and boron compounds, and silicon carbide.

As the aluminum compound, aluminum nitride (AlN), or aluminum oxide ($Al_2O_3$) can be used. As the boron compound boron carbide ($B_4C$), or boron nitride (BN) can be used.

Such sintered mixture shows semiconductivity, and contains high resistance regions and conductive regions in mixture. In the case of sintered mixtures of aluminum nitride or aluminum oxide or boron nitride with silicon carbide, the nitride or oxide for the high resistance regions, whereas silicon carbide forms the conductive regions. In the case of sintered mixture of boron carbide with silicon carbide, the boron carbide forms conductive regions, whereas the silicon carbide forms high resistance regions. In the case of sintered mixtures of two or more of the aluminum compound and the boron compound with silicon carbide, a mixed structure of high resistance regions and conductive regions can be obtained according to their specific resistances. A structural diagram of the typical sintered mixture is given in FIG. 1, where A shows conductive regions and B high resistance regions.

Effects of using such a sintered mixture as a rotor electrode will be explained as follows. The accumulated electric charges on the high resistance regions at the surface increase the local electric field and lowers the discharge voltage, resulting in reduced electric discharge energy. Furthermore, the high frequency current is controlled by the relatively high resistance effect of rotor electrode to suppress the radio noise generation.

To attain such effects, it is desirable that the specific resistance of sintered mixture is 10 to $10^6$ Ω·cm. With too low a specific resistance, no better resistance effect can be obtained, whereas with too high a specific resistance the rotor electrode turns electrically insulating, and can no more play a role of electrode.

When the sintered mixture for the rotor electrode comprises aluminum nitride and silicon carbide, it is preferable that it contains 20 to 80% by weight of aluminum nitride and 80 to 20% by weight of silicon carbide.

When the sintered mixture comprises aluminum oxide and silicon carbide, it is preferable that it contains 5 to 60% by weight of aluminum oxide and 95 to 40% by weight of silicon carbide.

When the sintered mixture comprises boron carbide and silicon carbide, it is preferable that it contains 1 to 50% by weight of boron carbide and 99–50% by weight of silicon carbide.

When the sintered mixture comprises silicon carbide, an aluminum compound and a boron compound, it is preferable that it contains 45 to 95% by weight of silicon carbide, the balance being the aluminum compound and the boron compound.

The sintered mixture for use in the present invention can be prepared by mixing raw material powders, molding the mixture, and sintering the molded mixture by means of hot press or pressureless sintering. When the sintered mixture is used as a rotor electrode, it can be easily mass-produced at low cost, because there is no necessity for combining with other parts of different material. The sintered mixture for use in the present invention also has a high strength.

DETAILED DESCRIPTION OF THE PREFERRED EMBODIMENTS

Figure 1:
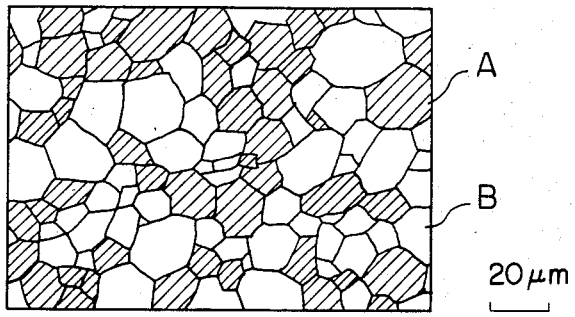
FIG. 1 is a structural diagram of sintered mixture according to the present invention.
Figure 2:
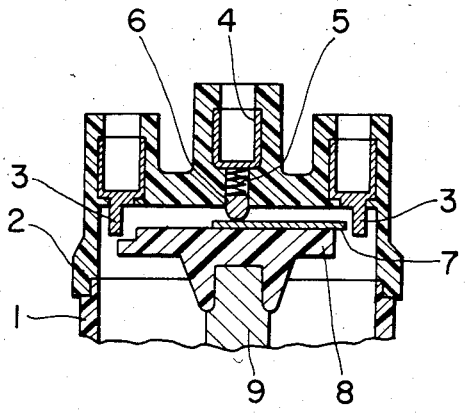
FIG. 2 is a vertical cross-sectional view of one embodiment of an ignition distributor for an internal combustion engine according to the present invention.

FIG. 2 shows a vertical cross-sectional view of an ignition distributor for an internal combustion engine according to one embodiment of the present invention.

Inside a cap 2 on a cylindrical housing 1 are embedded a plurality of stationary electrodes 3 arranged substantially in a circle. The stationary electrodes 3 are connected to ignition plugs provided in a plurality of cylinders in an internal combustion engine. A slidable contact rod 6 is provided at the center on the inside surface of cap 2 through a central terminal 4 and a conductive spring 5. A plate-formed rotor electrode 7 in contact with the contact rod 6 under a pressing force by the spring 5 is fixed to the surface of an insulating substrate 8, and the tip end of rotor electrode 7 faces the sides at the tip ends of stationary electrodes 3 through a small clearance. The insulating substrate 8 and the rotor electrode 7 rotate together with a cam shaft 9, and when the rotor electrode 7 comes to a position facing the stationary electrode 3, an electric discharge takes place between the rotor electrode 7, to which a high voltage is applied from the central terminal 4, and the stationary electrode 3 to allow an electric passage therebetween. At this moment, the high voltage is applied to an ignition plug connected to said stationary electrode 3.

It has been a problem that radio noise with high frequency is generated by the electric discharge between the stationary electrode 3 and the rotor electrode 7.

EXAMPLE 1

Black powder of silicon carbide (SiC) and powder of aluminum nitride (AlN) were mixed together in various mixing ratios.

Then, 10 parts by weight of a molding binder (5% polyvinyl alcohol solution) was added to 100 parts by weight of the resulting mixture, and the mixture was further mixed in a grinding mill for 30 minutes, and then passed through a 16-mesh screen to prepare a rotor electrode composition. The composition was premolded under a pressure of 1,000 kg/cm$^2$, and the premolded composition was sintered in a vacuum hot pressing apparatus of $10^{-4}$–$10^{-5}$ Torr at a temperature of 1,950° C. and a pressure of 300 kg/cm$^2$ for one hour. The resulting sintered product was cut into a desired shape to prepare a rotor electrode, which was fixed to the insulating substrate by a binder resin to prepare an ignition distributor as shown in FIG. 2.

Figure 3:
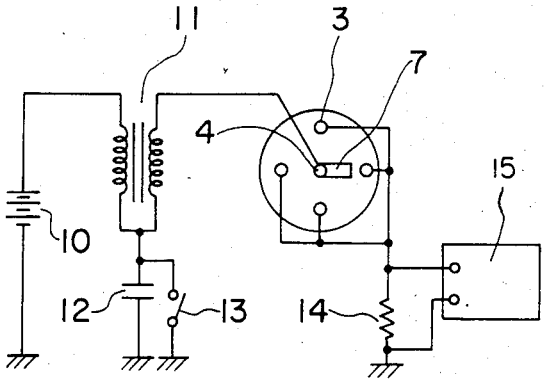
FIG. 3 is a circuit diagram for measuring a noise current generated in an ignition distributor for an internal combustion engine.

Electric noise current generated in the thus prepared ignition distributor was measured according to a measuring circuit shown in FIG. 3, where a battery 10 is connected to the primary side of an induction coil 11, and other terminal of induction coil 11 is earthed through a condenser 12. The condenser 12 is connected with a primary contact 13 in parallel. The secondary side of induction coil 11 is connected to the central terminal 4, which is further connected to the rotor electrode 7 through the contact rod. The stationary electrodes 3 are arranged in a circle around the rotor electrode 7 through a small clearance, and the individual terminals of stationary electrodes 3 are earthed through a resistor 14. Both ends of resistor 14 are connected to the input terminals of a noise-meter 15. When the primary contact 13 is turned on or off, a high voltage is generated at the secondary side of induction coil 11, and the high voltage is applied to rotor electrode 7. The rotor electrode 7 turns and electric discharging takes place in clearances between the rotor electrode 7 and the individual stationary electrodes 3. The electric discharge current passes to the earth through the resistor 14. Noise components generated by the electric discharging are input into the noise-meter 15. The stationary electrodes 3 are made of aluminum.

Table 1 shows compositions, relative densities, specific resistances, and measured electric noise currents of sintered mixtures prepared in rotor electrodes, and also shows measured electric noise currents when the conventional brass rotor electrode and rotor electrode provided with a resistor of 1.2 KΩ in the intermediate part were used for comparison.

TABLE 1

| | Sintered mixture composition (wt. %) | Relative density (%) | Specific resistance (Ω · cm), 20° C. | Electric noise current (dB) |
|---|---|---|---|---|
| 1 | SiC 100 | 83 | — | — |
| 2 | SiC 99.8-AlN 0.2 | 88.7 | $6 \times 10^2$ | — |
| 3 | SiC 99-AlN 1 | 95 | 8 | −3 |
| 4 | SiC 90-AlN 10 | 98.5 | 1.5 | −2.5 |
| 5 | SiC 80-AlN 20 | 98.7 | $1.9 \times 10^1$ | −11 |
| 6 | SiC 70-AlN 30 | 97.5 | $6 \times 10^1$ | −14 |
| 7 | SiC 50-AlN 50 | 98.0 | $2.5 \times 10^2$ | −18 |
| 8 | SiC 40-AlN 60 | 97.7 | $9 \times 10^3$ | −25 |
| 9 | SiC 20-AlN 80 | 94.0 | $4 \times 10^5$ | −27 |
| 10 | SiC 15-AlN 85 | 93.5 | $8 \times 10^8$ | −4 |
| 11 | SiC 10-AlN 90 | 93.0 | $>10^7$ | — |
| | Brass rotor electrode | | | 0 |
| | Rotor electrode with 1.2 kΩ resistor | | | −10 |

As is evident from Table 1, the specific resistance is fluctuated widely with poor reproducibility and less practicability when less than 10% by weight of AlN is contained. When the specific resistance is less than 10 Ωcm, no noise-suppressing effect can be obtained, whereas when the specific resistance is more than $10^7$ Ωcm, the resistance is so high that the current necessary for the electric discharging cannot pass and such sintered mixtures cannot be used as an electrode.

As is evident also from Table 1, the electric noise current is less than −10 dB, when the specific resistance of sintered mixtures is between 10 and $10^6$ Ωcm, as compared with the conventional brass rotor electrode, and a higher noise-suppressing effect than that of the conventional electrode can be obtained. It is seen that the sintered mixture composition to this effect contains 80 to 20% by weight of SiC and 20 to 80% by weight of AlN.

Similar noise-suppressing effects could be obtained when copper and stainless steel were used as the stationary electrodes.

EXAMPLE 2

Black powder of silicon carbide (SiC) and aluminum oxide ($Al_2O_3$) were mixed together in various mixing ratios, and the resulting mixtures were premolded under a pressure of 1,000 kg/cm$^2$ and sintered using a hot pressing apparatus at a temperature of 2,000° C. and a pressure of 200 kg/cm$^2$ for one hour in the similar manner as in Example 1. Rotor electrodes were prepared from the resulting sintered mixtures to fabricate ignition distributors for internal combustion engines. Then, the electric noise current was measured in the similar manner as in Example 1. The results are shown in Table 2.

As is evident from Table 2, the specific resistance of sintered mixture is 10 to $10^6$ Ωcm when they contain 5 to 60% by weight of $Al_2O_3$ and 95 to 40% by weight of SiC, and a high noise-suppressing effect can be obtained.

When copper and stainless steel stationary electrodes were used, the similar results could be obtained. When sintered mixtures prepared by sintering under the atmospheric pressure were used as rotor electrodes, the similar results could be obtained.

When the sintered mixtures were mounted as rotor electrodes in ignition distributors in the present example, no breakage was observed at all. It is seen that the sintered mixtures had a strength high enough to withstand the load applied during the fabrication.

TABLE 2

| | Sintered mixture composition (wt. %) | Specific resistance (Ωcm), 20° C. | Electric noise current (dB) |
|---|---|---|---|
| 12 | SiC 99-$Al_2O_3$ 1 | 3 | −2 |
| 13 | SiC 95-$Al_2O_3$ 5 | $1.5 \times 10^1$ | −12 |
| 14 | SiC 80-$Al_2O_3$ 20 | $1.2 \times 10^3$ | −19 |
| 15 | SiC 60-$Al_2O_3$ 40 | $3 \times 10^4$ | −24 |
| 16 | SiC 40-$Al_2O_3$ 60 | $8 \times 10^5$ | −20 |
| 17 | SiC 20-$Al_2O_3$ 80 | $>10^8$ | — |
| | Brass rotor electrode | | 0 |

EXAMPLE 3

Sintered mixtures comprising SiC and boron carbide ($B_4C$) were prepared in the similar manner as in Example 1, where the sintering conditions were a pressure of 200 kg/cm$^2$, a temperature of 2,000° C. and a sintering time of one hour.

Rotor electrodes were prepared from the sintered mixtures in the similar manner as in Example 1, and their specific resistance and electric noise current were measured. The results are shown in Table 3.

TABLE 3

| | Sintered mixture composition (wt. %) | Specific resistance (Ωcm), 20° C. | Electric noise current (dB) |
|---|---|---|---|
| 18 | SiC 99.5-$B_4C$ 0.5 | $>10^7$ | — |
| 19 | SiC 99-$B_4C$ 1 | $1.1 \times 10^5$ | −22 |
| 20 | SiC 90-$B_4C$ 10 | $6 \times 10^4$ | −27 |
| 21 | SiC 70-$B_4C$ 30 | $1.2 \times 10^3$ | −20 |
| 22 | SiC 50-$B_4C$ 50 | $2 \times 10^1$ | −13 |
| 23 | SiC 40-$B_4C$ 60 | 5 | −4 |
| | Brass rotor electrode | | 0 |

As is evident from Table 3, a particularly high noise-suppressing effect can be obtained at a sintered mixture containing about 90% by weight of SiC and about 10% by weight of $B_4C$. In the Al-based sintered mixtures, 40–60% by weight of an aluminum compound must be contained, whereas in the present B-based mixtures, only a smaller amount of $B_4C$ can attain the desired effect. That is, the high strength and the high resistance to heat shock which are characteristic of SiC can be fully retained. In other words, a smaller amount of the additive to SiC is more preferable, and $B_4C$ has a higher noise-suppressing effect with a smaller amount than the aluminum compound.

EXAMPLE 4

Sintered mixtures were prepared from silicon carbide, an aluminum compound and a boron compound in the similar manner as in Example 1, where the sintering conditions were a pressure of 300 kg/cm$^2$, a temperature of 2,000° C. and a sintering time of one hour. Rotor electrodes were prepared from the sintered mixtures and their specific resistance and electric noise current were measured in the similar manner as in Example 1. The results are shown in Table 4.

TABLE 4

| | Sintered mixture composition (wt. %) | Specific resistance (Ωcm), 20° C. | Electric noise current (dB) |
|---|---|---|---|
| 24 | SiC 95-BN 5 | $1.2 \times 10^5$ | −21 |
| 25 | SiC 50-BN 40-AlN 10 | $3 \times 10^4$ | −25 |
| 26 | SiC 60-BN 35-$Al_2O_3$ 5 | $8 \times 10^2$ | −17 |
| 27 | SiC 45-$B_4C$ 5-AlN 50 | $2 \times 10^2$ | −15 |
| 28 | SiC 50-$B_4C$ 10-$Al_2O_3$ 40 | $8 \times 10^3$ | −22 |
| | Brass rotor electrode | | 0 |

As is evident, from Table 4, the sintered mixtures of three compounds have a high noise-suppressing effect.

As described above, the present invention can provide an ignition distributor for an internal combustion engine with reduced electric discharge energy and suppressed radio noise generation.

What is claimed is:

1. An ignition distributor for an internal combustion engine, which comprises a rotor electrode capable of rotary motion and a plurality of stationary electrodes arranged substantially in a circle around the rotor electrode through an electric discharge clearance therebetween, the rotor electrode being a sintered mixture comprising silicon carbide and one of the aluminum compounds aluminum oxide or aluminum nitride and/or one of the boron compounds boron nitride or boron carbide, said sintered mixture having a specific resistance of 10 to $10^6$ Ωcm at room temperature.

2. An ignition distributor according to claim 1, wherein the sintered mixture contains 20 to 80% by weight of aluminum nitride and 80 to 20% by weight of silicon carbide.

3. An ignition distributor according to claim 1, wherein the sintered mixture contains 5 to 60% by weight of aluminum oxide and 95 to 40% by weight of silicon carbide.

4. An ignition distributor according to claim 1, wherein the sintered mixture contains 1 to 50% by weight of boron carbide and 99 to 50% by weight of silicon carbide.

5. An ignition distributor according to claim 1, wherein the sintered mixture contains 45 to 95% by weight of silicon carbide, the balance being one of the aluminum compounds and one of the boron compounds.

* * * * *